United States Patent [19]

Asari et al.

[11] 4,379,398

[45] Apr. 12, 1983

[54] PULL-BACK TYPE INDIRECT EXTRUSION PRESS

[75] Inventors: Akira Asari, Osaka; Tatsuhiko Noyori, Kobe; Tetsuro Takehata, Osaka, all of Japan

[73] Assignee: Kabushiki Kaisha Kobe Seiko Sho, Kobe, Japan

[21] Appl. No.: 272,019

[22] Filed: Jun. 9, 1981

[30] Foreign Application Priority Data

Jun. 12, 1980 [JP] Japan ..... 55-80779
Jun. 12, 1980 [JP] Japan ..... 55-83608[U]

[51] Int. Cl.[3] ..... B21C 29/00; B21C 33/00; B21C 35/04; B21C 23/21

[52] U.S. Cl. ..... 72/273.5; 72/253.1; 72/254; 72/255; 72/270; 72/453.12; 72/40

[58] Field of Search ..... 72/253.1, 254, 255, 72/259, 270, 272, 273.5, 265, 453.12, 39, 40

[56] References Cited

U.S. PATENT DOCUMENTS 3,216,233 11/1965 Pischel et al. ..... 72/270
3,563,073 2/1971 Fischer ..... 72/453.12
3,577,759 5/1971 Tandler ..... 72/254
3,695,081 10/1972 Gartner ..... 72/254
4,165,625 8/1979 Wagner et al. ..... 72/253.1

FOREIGN PATENT DOCUMENTS 622741 12/1935 Fed. Rep. of Germany ..... 72/265
1300499 10/1969 Fed. Rep. of Germany ... 72/453.12
1387870 12/1964 France ..... 72/270
53-47781 12/1978 Japan ..... 72/273.5
54-2613 2/1979 Japan ..... 72/259
1373676 11/1974 United Kingdom ..... 72/253.1

*Primary Examiner*—Lowell A. Larson
*Attorney, Agent, or Firm*—Oblon, Fisher, Spivak, McClelland & Maier

[57] ABSTRACT

A pull-back type indirect extrusion press is designed so that the scalping of billets can be effected inside the press independently of extrusion cycles and the scalped billet is allowed to stand by in a billet extrusion standby space which is provided with a heating element to heat the standby billet to maintain the same at a required temperature and into which a billet oxidation-preventive gas is admitted to prevent oxidation of the standby billet.

3 Claims, 7 Drawing Figures

PULL-BACK TYPE INDIRECT EXTRUSION PRESS

BACKGROUND OF THE INVENTION

1. Field of the Invention

The present invention relates to improvements in a pull-back type indirect extrusion press such that the scalping of billets can be performed inside the pressing machine independently of extrusion cycles and the scalped billet is allowed to remain in the machine in readiness for an extrusion cycle. The invention also provides means for prevention of cooling and temperature control of said scalped billet and for prevention of surface oxidation of said billet while it is held in the machine.

2. Description of the Prior Art

A pull-back type indirect extrusion press is known which comprises a pair of movable platens opposed to each other on opposite sides of a fixed central platen and connected together by tie rods, and a main cylinder mounted on said fixed platen for moving said movable platens, wherein a billet is placed on the press centerline between one movable platen and said fixed platen and is then charged into a container disposed between the other movable platen and said fixed platen and is extruded through a die stem to provide a required product. In this connection it is to be noted that the indirect extrusion press cannot process black (skin) billets without removal of their skins. Thus, conventionally, they have to be subjected to machining or scalping on a machine tool or scalper separate from the press prior to extrusion. From the standpoint of initial and running costs, it is advantageous to effect the scalping of billets inside the extrusion press. For this reason, there have recently been proposed some press designs having a scalping member built in the press, a typical one of which is adapted so that a billet is inserted into the billet container while being scalped by a scalping member, such as a scalping die, attached to the end opening in the container. This type of press, however, encounters the following problems.

The container is supported on a container holder and movably installed adjacent the fixed platen and, as is known in the art, a shearing member or device for severing discards must be installed in the space defined between the fixed platen and container, thus sometimes necessitating an operation intended to avoid interference with the scalping member. Further, a scalping cycle must of course be added to the extrusion cycle, thus lengthening the latter. As a result, the press mechanism and extrusion process become complex.

Another consideration which must be given to the indirect extrusion press is an taper heating, which is important technique involved in heating billets. The taper heating effect is liable to lessened as the hot billet tends to cool down prior to extrusion and hence maintaining the temperature to the hot billet is of special importance. Moreover, in the press of the type adapted to apply scalping to billets for removal of their skins while the billet is held in the press, the object of the problems of cooling and oxidation of hot billets become more pronounced.

SUMMARY OF THE INVENTION

In view of the state of the art described above, the invention is to provide a pull-back type indirect extrusion press having a billet scalping device built therein, wherein scalping can be effected independently of extrusion cycles, the scalped billet being allowed to remain in the press in readiness for an extrusion cycle without the need of lengthening or enlarging the press, and the container is adapted to be held in a fixed position during extrusion. More particularly, the invention provides a pull-back type indirect extrusion press comprising a pair of movable platens opposed to each other on opposite sides of a fixed platen and connected together by tie rods, and a main cylinder device provided on said fixed platen for driving said movable platens, wherein a space defined between one movable platen and said fixed platen serves as a billet zone where a billet loader, billet pusher and the like are installed, while a space defined between the other movable platen and said fixed platen serves as an extrusion zone where a container, die stem and the like are installed, said press being characterized by the provision of a scalping member in said billet zone, a scalped-billet standby space included in said billet zone and extending into the fixed platen, and a movable closure disposed in said extrusion zone and between said fixed platen and said container.

The object of the invention is also characterized by the provision of a billet extrusion standby space in said fixed platen where a heating element is installed, thereby solving the problem of cooling of hot billets. A further object of the invention is the provision of an oxidation-preventive gas inlet leading to said billet extrusion standby zone.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference charcters designate like or corresponding parts throughout the several views and wherein.

DETAILED DESCRIPTION OF THE PREFERRED EMBODIMENTS

Figure 2:
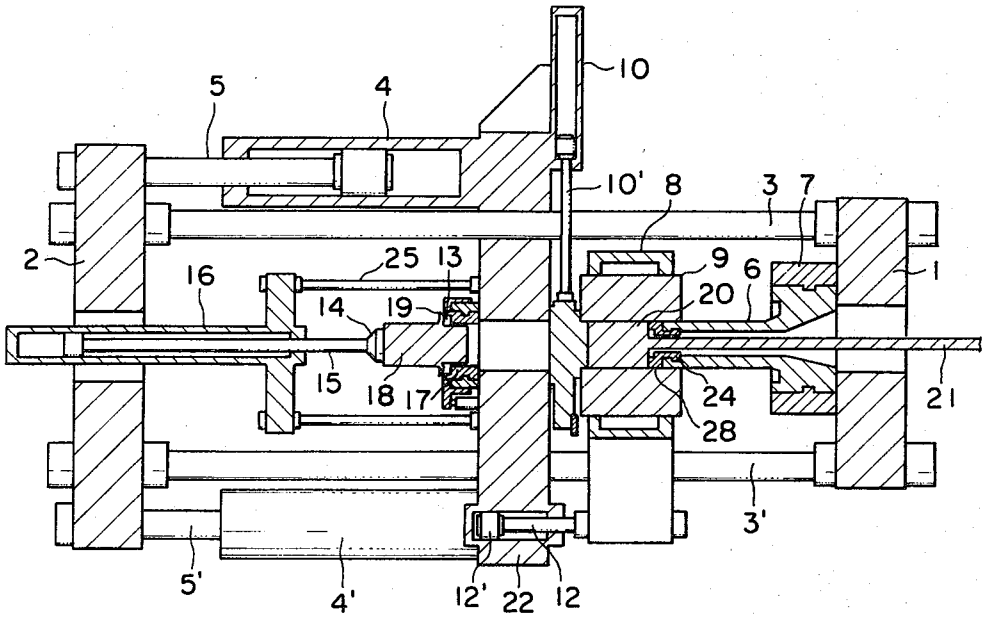
FIGS. 2, 3 and 4 are side views in longitudinal sections showing the scalping and extrusion of billets in order of operation.
Figure 3:
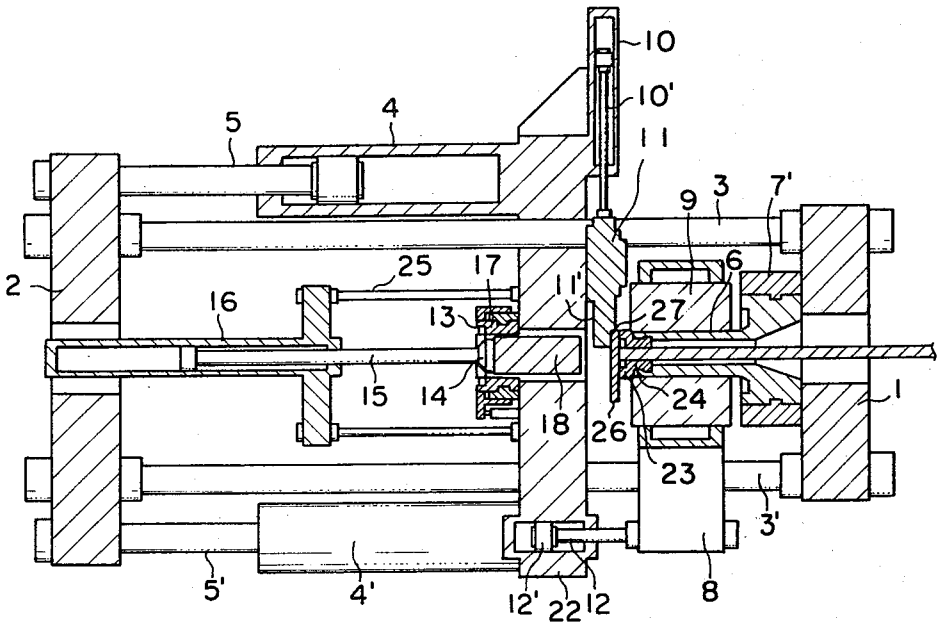
Figure 4:
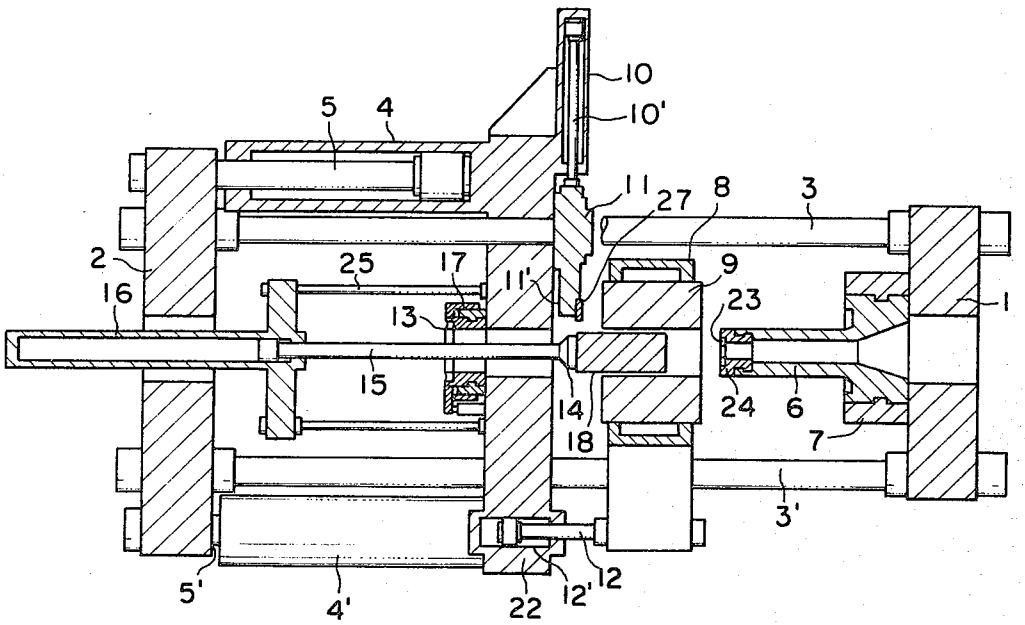

FIGS. 2, 3 and 4 are side views in longitudinal section, showing the scalping and extrusion of billets; a discard portion being severed and a scalped billet standing by; and said standby billet being charged into the container, respectively. In these figures, reference numeral 22 denotes a central fixed platen, which, is immovably fixed to a floor bed, foundation or the like (not shown). A pair of movable platens 1 and 2 are opposed to each other on opposite sides of said fixed platen 22. The movable platens 1 and 2 are connected together by a plurality of tie rods 3, 3' and one movable platen 2 is connected to the pistons 5, 5' (or rams) of a plurality of main cylinders 4, 4' installed on the fixed platen 22, so that the movable platens 1 and 2 can be moved in unison. The movable platens 1 and 2 are supported on a guide flame (not shown) to be guided during linear movement.

A space defined between said fixed platen 22 and one movable platen 1 serves as an extrusion zone Z1 where a die stem 6 is installed through a stem holder 7 on the movable platen 1, said die stem 6 carrying at the front end thereof a die 23 held in a die holder 24, and a container 9 is installed through a container holder 8 on the surface of the fixed platen directed to the movable platen 1, said container holder 8 being connected to a container moving piston 12 received in a cylinder 12' installed in the fixed platen 22. On the other hand, a space defined between the fixed platen 22 and the other movable platen 2 serves as a billet scalping zone Z2', unlike the conventional billet zone. In the zone Z2, a billet pusher cylinder 16 supported by tie rods 25, 25' is installed, leaving a space between it and the fixed platen 22 for passage of billet carry-in members, such as a billet loader and billet lifter (not shown), said cylinder 16 having movably received therein a pusher piston 15 formed with a pusher head 14, and a scalping die 13, serving as a scalping member, is installed on the fixed platen 22 through a scalping die holder 17 in opposed relation to said pusher piston 15 such that a billet passage hole in the scalping holder 17 cooperates with a billet passage hole in the fixed platen 22 to define a standby space Ls for a scalped billet to stand ready for extrusion.

Movably installed between the fixed platen 22 and the container 9 is a container closure block 11 which can partly fit into the inlet opening in the container 9 and which is held by the piston 10' of a block driving cylinder 10 which causes the block to enter and retract from the space between the fixed platen 22 and the container 9. A shearing blade 27 for severing discards is attached to an end block 11' on said block 11.

Figure 1:
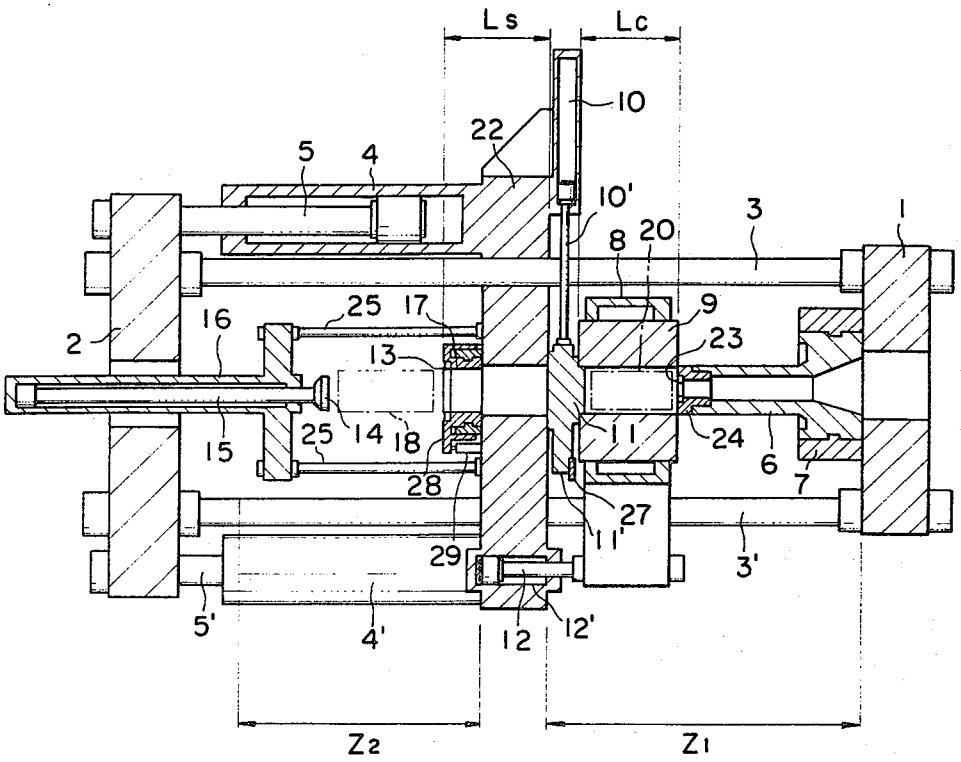
FIG. 1 is a side view, in longitudinal section, of a press according to an embodiment of the invention.

In addition, in FIG. 1, reference numeral 28 denotes a sleeve fitted on the scalping member and supported by a cylinder 29. It goes without saying that the die stem 6, container 9, scalping die 13 and billet pusher 14, 15, 16 are coaxial with the press axis.

In FIG. 2, reference numeral 18 denotes a billet being scalped; 19 denotes a portion of the skin of said billet; 20 denotes a billet being extruded inside the container 9; and 21 denotes an extruded product. In FIG. 3, the numeral 26 denotes a discard portion to be covered upon completion of extrusion.

The feeding, scalping and extrusion of billets according to the present press are performed in the following manner.

In the state of FIG. 1 showing the initial position of the press, a billet, as at reference numeral 18, is carried in by the billet loader and other billet carry-in members to be set in position in the billet carry-in space between the pusher head 14 of the billet pusher and the scalping die 13 in the zone Z2 so that the billet is coaxial with the press axis, as shown in phantom lines, whereupon the container closure block 11 is placed between the fixid platen 22 and the container 9 in the extrusion zone Z1, as shown. The container 9 has a scalped billet already charged thereinto, as will presently become apparent, and the movable platens 1, 2, stem 6, etc. are in the illustrated position. Then, as can be seen in FIG. 2 showing extrusion and scalping being performed, the main cylinder device 4, 4' is actuated to cause the main pistons 5, 5' to move the movable platens 1 and 2 to the left, as viewed in the figure, whereby the extrusion die 23 held in the die stem 6 on the movable platen 1 is forced into the container 9, thereby effecting indirect extrusion of the scalped billet 20 in cooperation with the container closure block 11, which is now closes the container and supports the rear end of the billet. On the other hand, in the billet scalping zone Z2, the pusher cylinder 16 is actuated to move the pusher piston 15 to the right, as viewed in the figure, independently of the extrusion process, whereby the billet 18 carried in is forced against the scalping die 13 to have its skin 19 removed by the latter, and eventually the billet 18 is fed into the standby space Ls between the scalping die holder 17 and the fixed platen 22. In this way, the extrusion product 21 from extrusion of the billet 20 is obtained and the scalping of the billet 18 carried in is executed inside the press independently of and concurrently with the extrusion. Thus, the final stage shown in FIG. 3 is reached. In FIG. 3, in the zone Z2, the billet 18, which has undergone scalping, is held in the standby space Ls between the scalping die 13 and the fixed platen 22, while in the zone Z1 the cylinder 12' is actuated to cause the piston 12 to move the container 9 a slight distance sufficient to disengage the container 9 from the container closure block 11 and while the cylinder 10 for the block 11 is actuated to cause the piston 10' to lift the block 11 once and then lower the same, whereby the shearing member 27 attached to the end block 11' on the block 11 cuts off the discard 26 remaining on the surface of the extrusion die 23.

Then, as shown in FIG. 4 illustrating a billet charging stage, the shearing member 27, after shearing, is lifted by the cylinder 10 for the closure block 11 while the movable platens 4, 4' are retracted to the right, as viewed in the figure, by the main cylinder device 4, 4' to thereby retract the extrusion die 23 held in the die stem 6 from the container 9 and while the scalped billet 18 standing by in the standby space Ls is charged into the container 9 by the pusher head 14, whereupon the pusher piston 15 is retracted. Then, the closure block 11 is lowered by the cylinder 10 and the container 9 in the container holder 8 is retracted by the cylinder 12' into engagement with the block 11 to be closed by the latter, whereupon the movable platens 1 and 2 are somewhat moved to the left, as viewed in the figure, by the main cylinder device 4, 5 to bring the extrusion die 23 into contact with the scalped billet 20, in the container 9, establishing the initial position of FIG. 1.

As has been described so far, the press of the invention carries out a series of operations; scalping a charged billet 18, holding said billet in readiness for extrusion, extruding a scalped billet 20 charged into the container 9, and shearing the discard portion. It should be noted that the scalping and holding of the charged billet 18 in readiness are independent of an extrusion which takes place on the other side.

Figure 5:
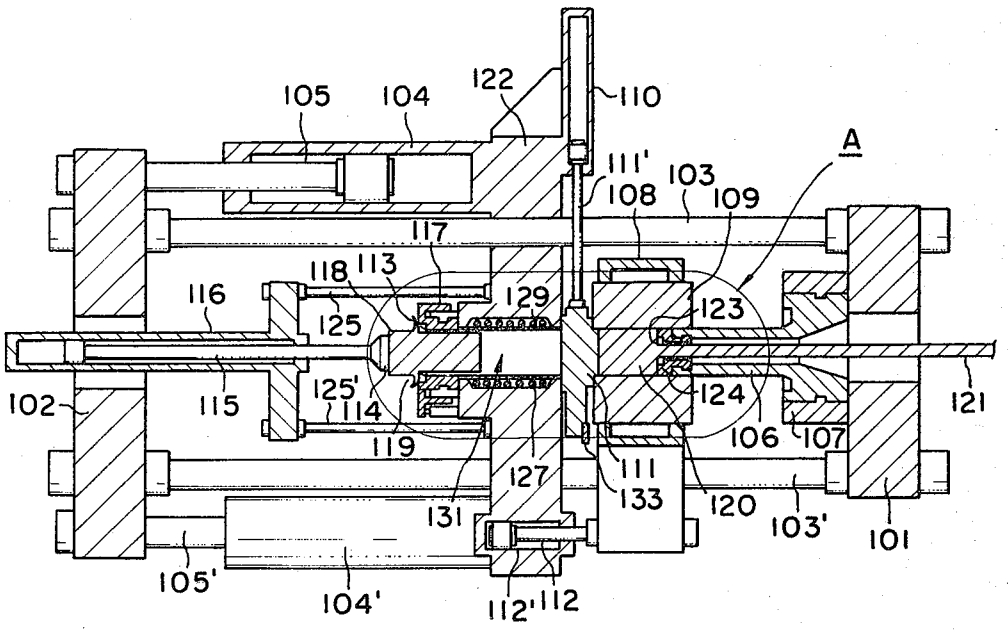
FIG. 5 is a side view, in longitudinal section, of a press according to another embodiment of the invention.
Figure 6:
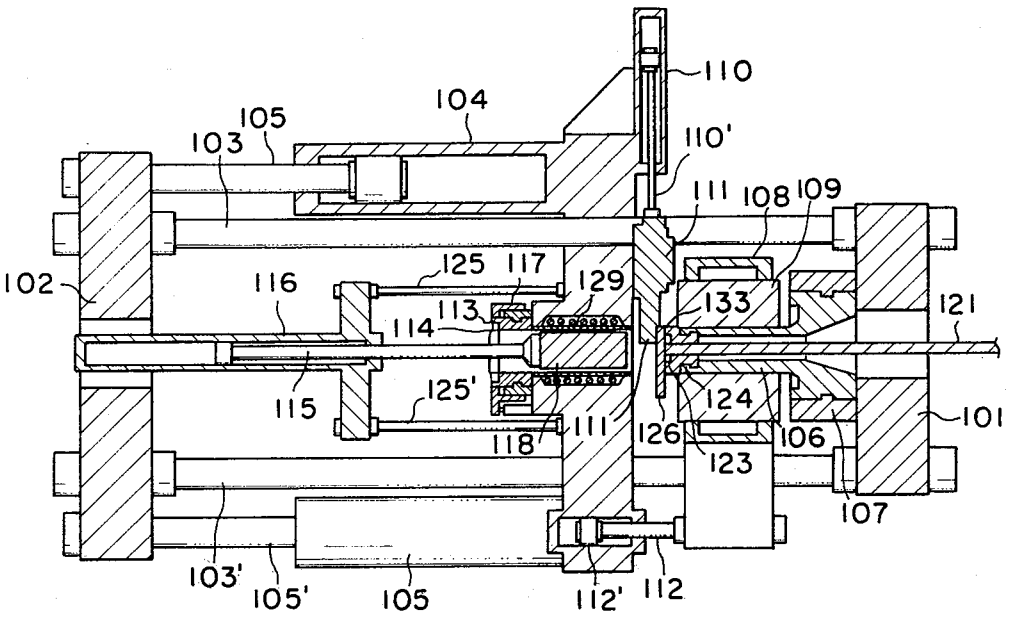
FIG. 6 is a side view in longitudinal section, showing a billet being heated.
Figure 7:
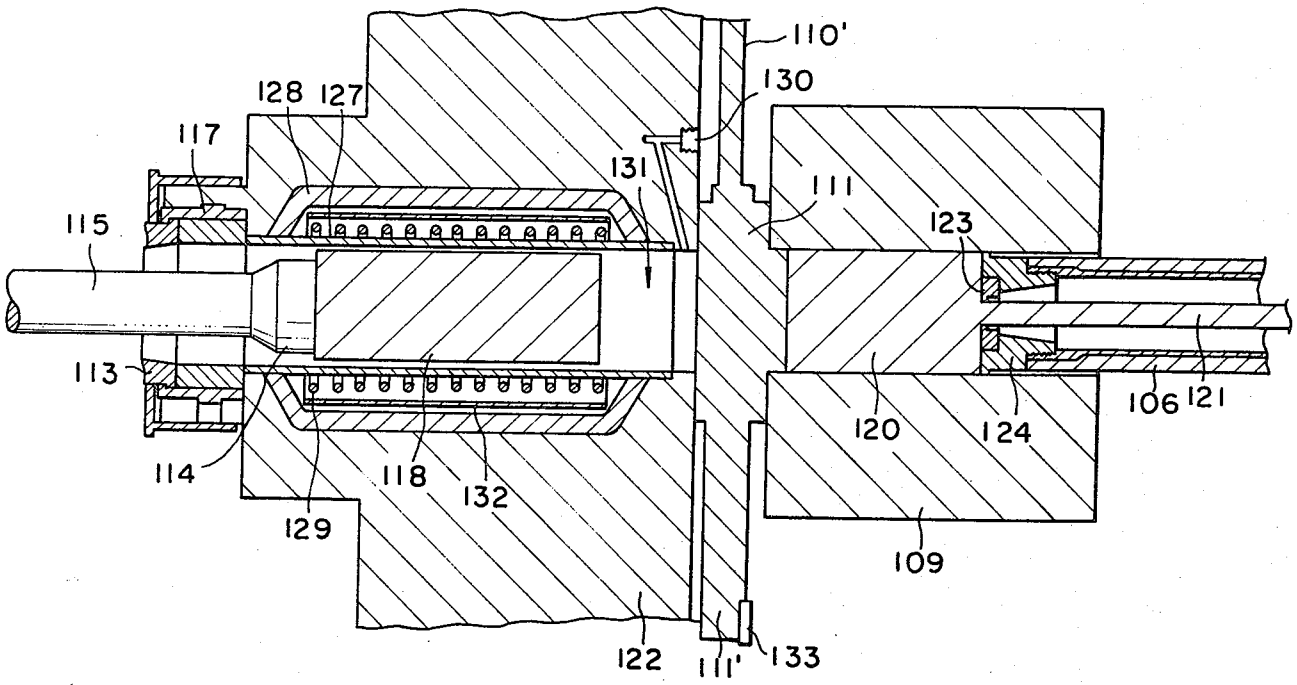
FIG. 7 is an elarged side view in section, showing an extrusion standby space.

Another aspect of the invention will now be described with reference to FIGS. 5 through 7. FIG. 5 is a side view, in longitudinal section, of a press according to another embodiment of the invention; FIG. 6 is a side view in longitudinal section, showing the heating of a billet held in readiness; and FIG. 7 is an enlarged side view in section, showing a billet extrusion standby space. In FIG. 5, reference numeral 122 denotes a central fixed platen, which is immovably fixed to a floor bed, foundation or the like (not shown). A pair of movable platens 101 and 102 are opposed to each other on opposite sides of said fixed platen 122. The movable platens 101 and 102 are connected together by a plurality of tie rods 103, 103' and one movable platen 102 is connected to the pistons 105, 105' (or rams) of a plurality of main cylinders 104, 104' installed on the fixed platen 122, so that the movable platens 101 and 102 can be moved in unison. The movable platens 101 and 102 are supported on a guide frame (not shown) to be guided during linear movement.

A space defined between said fixed platen 122 and one movable platen 101 serves as an extrusion zone where a die stem 106 is installed through a stem holder 107 on the movable platen 101, said die stem 106 carrying at the front and thereof a die 123 held in a die holder 124, and a container 9 is installed through a container holder 108 on the surface of the fixed platen directed to the movable platen 101, said container holder 108 being connected to a container moving piston 112 received in a cylinder 112' installed in the fixed platen 122. On the other hand, a space defined between the fixed platen 122 and the other movable platen 102 serves as a biliet scalping zone, where a billet pusher cylinder 116 supported by tie rods 125, 125' is installed, leaving a space between it and the fixed platen 122 for passage of billet carry-in members, such as a billet loader and billet lifter (not shown), said cylinder 116 having movably received therein a pusher piston 115 formed with a pusher head 114. In such pull-back type indirect extrusion press, according to the invention, a billet extrusion standby space 131 is formed in the fixed platen 122 coaxially with the press axis, where a billet carried therein is ready to be carried into the container 109 in the extrusion zone. The space 131 is in the form of a through hole allowing a billet to be held therein and pass therethrough, as shown. A heating structure for heating billets is provided surrounding said space 31. Further, an oxidation-preventive gas feeding structure is provided, as shown in FIG. 3. More particularly, a protective sleeve 127 is fitted to define said space 131, while a heater element 129 is installed in the fixed platen 122 such that it is positioned outwardly of the protective sleeve 127 to surround the space 131, said heater element being surrounded with a sleeve 132 and a heat insulator 128. Further, an inlet port 130 for an oxidation-preventive gas, such as inert gas, which leads to the space 131 is provided by making use of the platen 122. Though not shown, the inlet port 130 has a feed pipe or the like connected thereto so as to feed inert gas or the like from outside the machine into the space 131.

Thus, a scalped billet 118 is held in its standby position in the space 131 in readiness for the next extrusion, during which standby time the heater element 129 installed in the space 131 heats the billet 118 to maintain it at a required temperature, so as to prevent undesirable or detrimental cooling of the billet, while inert gas or the like is admitted through the oxidation-preventive gas inlet port 130 into the space 131, thereby preventing oxidation of the billet.

According to the invention, the conventional two-unit arrangement consisting of a press and a scalper separate from the latter is no longer necessary. The invention is also superior to the conventional means for effecting the scalping of billets inside the press, in the following respects.

The scalping cycle is not inseparably incorporated in the extrusion cycle; rather, of the extrusion and billet zones on opposite sides of the fixed platen 1, the billet zone is used as a billet scalping zone Z2, so that the scalping of the billet 18 for removal of the skin 19 is effected independently of the extrusion cycle and the extrusion cycle time, assigned to extrusion, is reduced as compared with the usual extrusion cycle time. This is achieved for the first time by the arrangement of the invention which includes the pusher cylinder 16 and which enables the billet 18 scalped in the standby space Ls to standby in the latter. In this connection, it is to be noted that a closure, such as the closure block 11, is movably installed between the fixed platen 22 and the container 9, thereby preventing slip-off of the billet 18 during the standby time and providing stable support for the billet 18 during extrusion. The shearing member 27 for cutting off discards can be conveniently attached to the end block 11' on the block 11. Further, the container 9 is held immovable during extrusion. Therefore, container holding accuracy and hence extrusion accuracy are improved.

The cooling and oxidation of hot billets are prevented by the novel structures according to the invention.

It will thus be seen that the invention has solved the problems with the pull-back type indirect extrusion press.

Obviously, numerous modifications and variations of the present invention are possible in light of the above teachings. It is therefore to be understood that within the scope of the appended claims, the invention may be practiced otherwise than as specifically described herein.

What is claimed is:

1. A pull-back type indirect extrusion press comprising:

a fixed platen;

a plurality of tie rods;

a first and second movable platen opposed to each other on opposite sides of said fixed platen connected together by said plurality of tie rods;

a main cylinder device provided on said fixed platen for driving said first and second movable platens, wherein a space defined between said first movable platen and said fixed platen serves as a billet zone, while a space defined between the second movable platen and said fixed platen serves as an extrusion zone having a container therein;

a scalping member disposed in said billet zone wherein a scalped-billet standby space formed in said billet zone and extends into the fixed platen; and a movable closure member diposed in said extrusion zone and between said fixed platen and said container.

2. A billet heating device for pull-back type indirect extrusion presses comprising:

a fixed platen;

a plurality of tie rods;

a first and second movable platen opposed to each other on opposite sides of said fixed platen and connected together by said plurality of tie rods;

a main cylinder device provided on said fixed platen for driving said first and second movable platens, wherein a space defined between said first movable platen and said fixed platen serves as a billet zone, while a space defined between the second movable platen and said fixed platen serves as an extrusion zone; and a billet heating device provided in a billet extrusion standby space located in said fixed platen.

3. A billet heating device for pull-back type indirect extrusion presses as set forth in claim 2, which further comprises billet oxidation-preventive gas inlet port means leading to said billet extrusion standby space.

* * * * *

UNITED STATES PATENT AND TRADEMARK OFFICE

CERTIFICATE OF CORRECTION

PATENT NO. : 4,379,398

DATED : April 12, 1983

INVENTOR(S) : AKIRA ASARI ET AL

It is certified that error appears in the above—identified patent and that said Letters Patent is hereby corrected as shown below:

In column 1, line 53, delete "an" before "taper";

In column 1, line 54, before "important" insert therefor --an--;

In column 1, line 55, before "lessened" insert therefor --be--;

In column 1, line 60, delete "object of the";

In column 1, line 66, before "invention" insert therefor --object of the--;

In column 2, line 49, delete "elarged" and insert therefor --enlarged--;

UNITED STATES PATENT AND TRADEMARK OFFICE

CERTIFICATE OF CORRECTION

PATENT NO. : 4,379,398

DATED : April 12, 1983

INVENTOR(S) : AKIRA ASARI ET AL

It is certified that error appears in the above—identified patent and that said Letters Patent is hereby corrected as shown below:

In column 3, line 14, delete "Z2'" and insert therefor --Z2--;

In column 3, line 58, delete "fixid" and insert therefor --fixed--;

In column 4, line 3, delete "is now closes" and insert therefor --now closes--;

In column 5, line 11, delete "and" after "front" and insert therefor --end--;

In column 5, line 18, delete "biliet" and insert therefor --billet--;

In column 6, line 45, delete "diposed" and insert therefor --disposed--.

Signed and Sealed this

Twentieth Day of September 1983

[SEAL]

Attest:

GERALD J. MOSSINGHOFF

Attesting Officer

Commissioner of Patents and Trademarks